United States Patent [19]

Bolieau

[11] 4,424,746

[45] Jan. 10, 1984

[54] LEAD DETONATOR SHOCK ABSORBER

[75] Inventor: Christopher W. Bolieau, Brigham City, Utah

[73] Assignee: Thiokol Corporation, Chicago, Ill.

[21] Appl. No.: 344,848

[22] Filed: Feb. 1, 1982

[51] Int. Cl.[3] ..... F42C 15/34

[52] U.S. Cl. ..... 102/254; 102/202.1

[58] Field of Search ..... 102/254, 262, 202.1, 102/221, 222, 275.11; 89/1 B

[56] References Cited

U.S. PATENT DOCUMENTS

| | | | |
|---|---|---|---|
| 3,380,385 | 4/1968 | Hazelet et al. | 102/254 |
| 3,439,617 | 4/1969 | Boyd et al. | 102/254 |
| 3,529,418 | 9/1970 | Puckett et al. | 102/254 X |
| 3,547,033 | 12/1970 | Gawlick et al. | 102/254 |
| 3,618,527 | 11/1971 | Kilmer | 102/254 |
| 4,202,271 | 5/1980 | Day | 102/262 X |
| 4,337,702 | 7/1982 | Betts | 102/254 |

*Primary Examiner*—David H. Brown

*Attorney, Agent, or Firm*—Gerald K. White

[57] ABSTRACT

A barrier assembly for a safety and arming electro-explosive device of the type comprising a rotor containing detonators and rotatable between safe and arm positions includes a body of lead as an energy absorbing material in the safe position of the device. When the shock wave from a detonator hits the lead, the lead flows and attenuates the shock wave. Cycling after the device has been fired in the safe position is precluded by an undercut in the rotor into which the lead flows, thus preventing rotor rotation after firing.

7 Claims, 4 Drawing Figures

LEAD DETONATOR SHOCK ABSORBER

BACKGROUND OF THE INVENTION

1. Field of the Invention

This invention relates to an electroexplosive safety and arming device for use in munitions, and particularly to an improved barrier assembly for use in such a device.

2. Description of the Prior Art

For purposes of safety it is desirable in high explosive fuzing systems to mechanically separate the more sensitive components from the rest of the explosive train until such time as it is desired to arm the fuze. In such systems rotors and sliding bars are provided which house the sensitive components, the rotors or sliding bars being rotated or translated, respectively, to position the explosive trains as desired.

Electromechanical safety and arming devices have two primary positions, an armed position and a safe position. In the armed position electric initiators or squibs having a flame output are positioned in line with the next step in the ignition train. In the safe position the electric initiators or squibs are rotated or translated out of line with the ignition train so that if then activated they are vented harmlessly into the interior of the device.

An electroexplosive safety and arming device utilizes detonators which produce high energy shock waves when fired. The output of such detonators is more difficult to contain than the flame output of electric squibs used in ignition functions. Heavy and bulky housings, accordingly, have been required in the prior art for housing electroexplosive safety and arming devices. Additionally, notwithstanding the use of such heavy and bulky housings, the actuation portions of the devices have been subject to damage upon firing in either the armed or the safe position, and as a consequence, have not been reusable. Also, it has not been possible to meet a requirement of some munitions systems that it be impossible to cycle the electroexplosive device after it has been fired in the safe position.

SUMMARY OF THE INVENTION

An object of the invention is to provide an improved barrier assembly for use in electroexplosive devices that effects such attenuation of the shock wave from the detonator that firing the detonator in either the armed or the safe position does not damage the actuation portion of the device whereby such actuation portion is recoverable and is reusable.

Another object of the invention is to provide such an improved barrier assembly that allows use of a lighter housing for the electroexplosive device thereby minimizing both weight and bulk of the explosive device.

A further object of the invention is to provide such an improved barrier assembly that readily meets the requirement of some systems that it be impossible to cycle after fire in the safe position.

In acccomplishing these and other objectives of the invention, there is provided an electroexplosive device having a barrier assembly including a rotor and a body of lead incorporated as an energy absorbing material in the safe position of the device. When a shock wave from the detonator hits the lead, the lead flows and attenuates the shock wave. For meeting the requirement that it be impossible to cycle the device after it has fired in the safe position, a cut out or undercut is formed on the rotor and the lead is so configured as to flow into such cut out upon such firing the device thus preventing rotor rotation to the arm position after firing of the device in the safe position.

For a fuller understanding of the nature and objects of the invention, reference is made to the following detailed description taken in conjunction with the accompanying drawings.

DESCRIPTION OF THE PREFERRED EMBODIMENT

Figure 1:
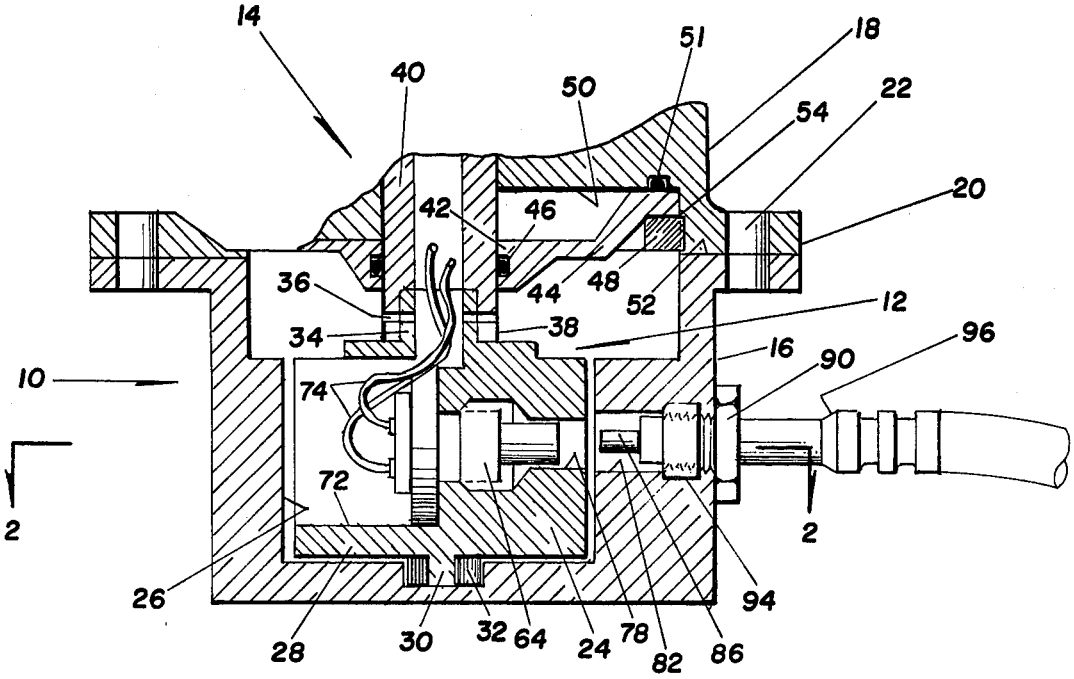
FIG. 1 is a fragmented elevational view partly in cross-section of the electroexplosive device according to the invention showing the barrier assembly in its armed position.
Figure 2:
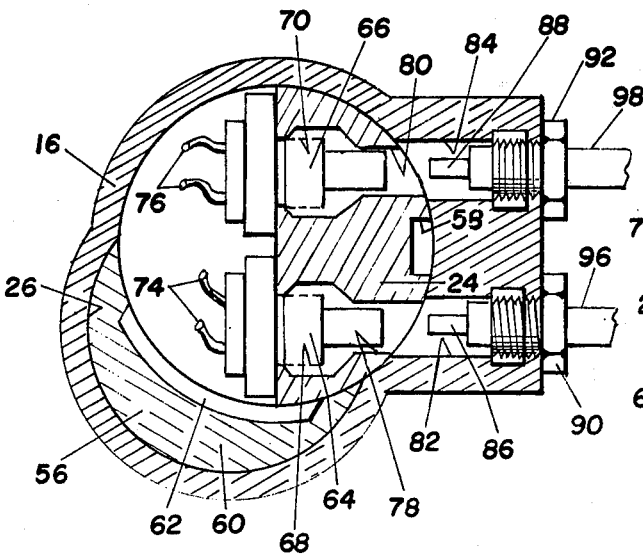
FIG. 2 is a view, partly in cross-section, of the invention embodiment of FIG. 1 taken along the lines 2—2 thereof.

In the drawings like reference numerals refer to like parts throughout. Referring particularly to FIGS. 1 and 2, the numeral 10 generally designates an electroexplosive device. The electroexplosive device 10 includes a barrier assembly 12 and an actuation assembly 14, both of which assemblies are contained within a housing 16 that is provided with a cover or closure member 18. Adjacent edges of housing 16 and closure member 18 form a mounting flange 20 having holes 22 therein for fixedly attaching the electroexplosive device 10 to a suitable supporting bracket or other member (not shown).

The barrier assembly 12 includes a rotor 24 having the general shape of a cylinder. Rotor 24 is arranged to be rotated in a generally cylindrical opening 26 that is provided in housing 16. To this end, the rotor 24 is provided at a first end 28 with a shaft 30. Shaft 30 is located on the axis of rotation of rotor 24 and is journaled in a bearing 32 that is formed in the wall of housing 16. The opposite end of rotor 24 is provided with a hollow hub 34 that is attached by a pin 36 to a first end 38 of a hollow shaft 40.

The shaft 40 comprises a portion of the actuation assembly 14 and extends through an opening 42 of a dished supporting bracket 44, as seen in FIG. 1. An O-ring 46 is provided in the opening 42 for effecting a seal and for ensuring a snug fit of the hollow shaft 40 therein. The bracket 44 is supported at its edges on a shoulder that is provided by an annular ring 48. Thus, bracket 44 is pressed against the upper surface of ring 48 by the lower surface 50 of the closure member 18, an O-ring 51 being provided for sealing purposes. Annular ring 48 is held between the upper edge surface 52 of housing 16 and a shoulder 54 that is provided internally of closure member 18.

Inasmuch as the actuation assembly 14 per se forms no part of the present invention, it will not further be described except to note that at a second end (not shown) of the shaft 40, a suitable knob or handle is provided externally of closure member 18, for rotating the shaft 40 and thereby the rotor 24 for effecting adjustment of the electroexplosive device 10 between the safe and armed positions thereof.

Figure 3:
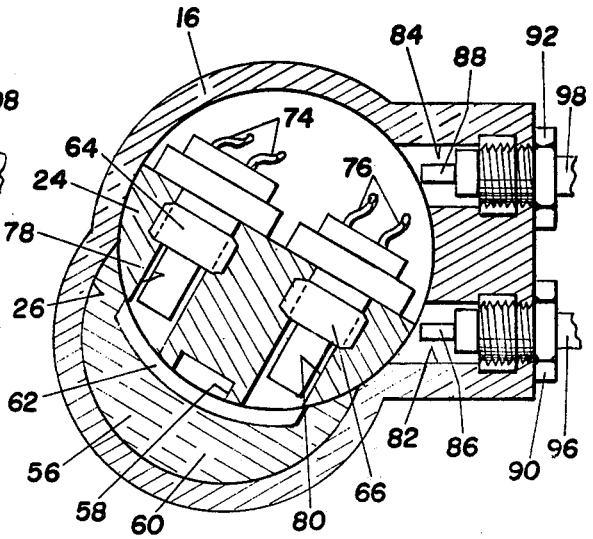
FIG. 3 is a cross sectional view similar to FIG. 2 but showing the barrier assembly in its safe position.

In the safe position, as illustrated in FIG. 3, the rotor 24 has been adjusted to a first extreme position relatively to the housing 16. In the armed position, as illustrated in FIGS. 1 and 2, the rotor 24 has been adjusted approximately 120° counterclockwise from the position of FIG. 3 to a second extreme position.

Figure 4:
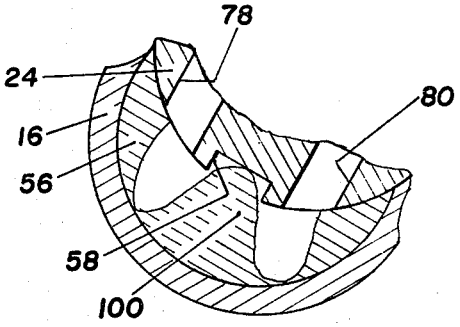
FIG. 4 is a fragmented view similar to FIG. 3 but shows the barrier assembly after firing of the electroexplosive device in the safe position thereof.

Further included in the barrier assembly 12 is a space or gap 56 that, in cross section, as seen in FIGS. 2-4, is crescent shaped. Space 56 is formed in the opening 26 of housing 16, intermediate the ends of opening 26, between the rotor 24 and the inner wall of housing 16. The space 56 extends partially around the curved inner surface of opening 26, embracing about a third of the circumference of the rotor 24. As seen in FIG. 3, the location of the space 56 is such that with the rotor 24 in the first mentioned extreme or safe position, a cut out or undercut 58 provided on the surface of rotor 24 is disposed substantially centrally of the space 56.

In accordance with the invention, there is provided within the space 56 a body of lead 60 that substantially but not entirely, fills the space 56. One side of the body of lead 60 is in contact with the wall surface of opening 26 over the full length of the crescent shaped space 56. The configuration of the body of lead 60 normally is such as to provide a curved space indicated at 62 between the other side of the body of lead 60 and the rotor 24, as shown in FIGS. 2 and 3.

Arranged within the rotor 24 are detonators 64 and 66 comprising large, high output units containing a high explosive such as RDX, PETN or lead azide. By way of example and not limitation, the detonators 64 and 66 may be of the type described in U.S. Pat. No, 3,971,320 issued to John T.M. Lee on July 27, 1976. Each of the detonators 64 and 66 is housed within an individually associated recess 68 and 70, respectively in the rotor 24, the recesses 68 and 70 being located within a larger recess 72, as seen in FIG. 1, the recess 72 being intermediate the ends of rotor 24.

Electrical leads for actuating the detonators 64 and 66 extend through the hollow hub 34 of rotor 24 and through the hollow shaft 40 to an external source of electricity, such leads indicated at 74 being connected to detonator 68 and leads 76 being connected to detonator 70.

Cylindrical ports 78 and 80 extend from the recesses 68 and 70, respectively to the circumferential surface of rotor 24. Each port 78 and 80, as shown, desirably has a diameter less than that of the recess 68 or 70 from which it extends.

Provided in the wall of housing 16, slightly spaced from the rounded surface of rotor 24, are cylindrical ports 82 and 84, the diameters of each of the ports 82 and 84 being substantially the same as the diameters of each of the ports 78 and 80. With the rotor 24 in the armed position of the electroexplosive device 10, as illustrated in FIGS. 1 and 2, the ports 78 and 80 are longitudinally aligned, in spaced relation, with the ports 82 and 84, respectively.

Located within each of the ports 82 and 84 in the wall of housing 16 is an individually associated receptor charge 86 and 88, respectively. As illustrated in FIG. 1 receptor charge 86 is shown mounted in a fitting 90. Fitting 90 is retained in an enlarged outer opening 94 of port 82, being in threaded engagement with a tap provided in the opening 94. The receptor charge 86 may be connected, as illustrated, to a train of detonating cord indicated at 96. A similar train of detonating cord 98 may be associated with the receptor 88 together with an associated fitting 92 that is mounted similarly to the fitting 90. Each cord 96 and 98 typically may include a high explosive core such as pentaerythritol tetranitrate, and in use, may be arranged to actuate a remote high explosive charge, through a bulkhead, for example.

By reference to FIG. 3, it is seen that in the safe position of the electroexplosive device 10, the ports 82 and 84 are longitudinally out of line with the detonator ports 78 and 80, the later being in line with the crescent shaped opening 56 containing the body of lead 60. As a result, in the event of accidental firing of the detonators 64 and 66 with the device 10 in the safe position, the detonators 64 and 66 are positioned to vent harmlessly into the interior of the device 10. Specifically, when the shock wave from one or both of the detonators 64 or 66 hits the body of lead 60, the lead 60 acts as an energy absorbing material and attenuates the shock wave. Further, with the lead 60 configured as illustrated, the lead 60 flows into the cut out or undercut 58 on the rotor 24 as indicated at 100 in FIG. 4. This prevents rotation of the rotor 24 and cycling of the electroexplosive device 10 after firing thereof in the safe position.

Thus, there has been provided, in accordance with the present invention, an improvement in a barrier assembly for use in an electroexplosive device wherein a body of lead is employed as an energy absorbing material in the safe position of the device and attenuates the shock wave upon firing of the device in the safe position. The invention is further characterized in the provision of a cut out or undercut in the rotor and a configuration of the body of lead that results in the lead flowing into the cut out thereby preventing rotation of the rotor and cycling of the device after it has been fired in the safe position.

It will be apparent to those skilled in the art that the improved barrier assembly of the present invention can be employed in any electroexplosive safety and arming device and adapted to fit into existing actuating assemblies. The improved barrier assembly is particularly useful with very high output detonators in a confined space.

Advantages of the improved barrier assembly are:

1. Firing the detonators 64 and 66 in either the safe or armed position of the device does not damage the actuation assembly 14 whereby the latter is recoverable and reusable.
2. The use of the lead energy absorber 60 allows the use of a lighter housing 16 for the electroexplosive device 10, thereby minimizing weight and bulk.
3. The "no cycle after fire in safe position" requirement of some munitions systems can be readily met.

Inasmuch as changes may be made in the improved barrier according to the present invention without departing from the spirit and scope of the invention, it is intended that all matter contained in the description herein or shown in the accompanying drawings be interpreted as illustrative and not in a limiting sense.

What is claimed is:

1. A barrier assembly for a safety and arming electroexplosive device comprising, a housing having a generally cylindrical opening therein, a rotor having a generally cylindrical surface positioned in said opening and rotatable between a safe position and an arm position, said rotor having at least a first recess provided therein and an associated first port leading from said recess to the circumference of said rotor, a detonator positioned in each recess provided in said rotor, said opening in said housing being formed to provide a crescent shaped space between the wall thereof and the surface of said rotor, and a body of lead positioned in said space, said lead substantially but not entirely filling said space, said first port being disposed adjacent said space and body of lead with said rotor in the safe position thereof.

2. A barrier assembly for a safety and arming electroexplosive device as specified in claim 1 wherein said rotor includes a second recess therein adjacent said first recess transversely of the axis of rotation of said rotor, an associated second port leading from said second recess to the cylindrical surface of said rotor, said first and second ports being disposed adjacent said space and body of lead with said rotor in the safe position of the electroexplosive device.

3. A barrier assembly for a safety and arming electroexplosive device as specified in claim 2 wherein said housing includes spaced third and fourth ports, said first and second ports in said rotor being in longitudinal alignment, respectively, with said third and fourth ports with said rotor in the arm position thereof.

4. A barrier assembly for a safety and arming electroexplosive device as specified in claim 3 further including a receptor charge positioned in each of said third and fourth ports.

5. A barrier assembly for a safety and arming electroexplosive device as specified in claim 1 further including a cut out in the surface of said rotor, said cut out being disposed adjacent said crescent shaped space and said body of lead with said rotor in the safe position thereof whereby upon firing of the electroexplosive device in the safe position of said rotor, said body of lead acts as an energy absorbing material and attenuates the shock waves from the detonator, said body of lead flowing into the cut out in the surface of said rotor and preventing rotation thereof.

6. A barrier assembly for a safety and arming electroexplosive device as specified in claim 5 wherein said rotor includes a second recess therein adjacent said first recess transversely of the axis of rotation of said rotor, an associated second port leading from said second recess to the cylindrical surface of said rotor, said first and second ports being disposed adjacent said space and body of lead with said rotor in the safe position of the electroexplosive device, and wherein said housing includes spaced third and fourth ports, said first and second ports in said rotor being in longitudinal alignment, respectively, with said third and fourth ports with said rotor in the arm position thereof.

7. A barrier assembly for a safety and arming electroexplosive device as specified in claim 6 further including a receptor charge positioned in each of said third and fourth ports, and wherein a cord having a high explosive core is attached to each of said receptors.

* * * * *